United States Patent [19]

Michikawa

[11] 4,339,918

[45] Jul. 20, 1982

[54] MEANS FOR ACCELERATING THE DISCHARGE OF EXHAUST GAS FROM AN INTERNAL COMBUSTION ENGINE

[76] Inventor: Hirokuni Michikawa, 1-115, Minamieguchi-cho, Higashiyodogawa-ku, Osaka-shi, Osaka-fu, Japan

[21] Appl. No.: 186,035

[22] Filed: Sep. 11, 1980

[51] Int. Cl.[3] ..... F02B 35/00

[52] U.S. Cl. ..... 60/316; 60/317; 181/279; 181/280

[58] Field of Search ..... 60/317, 319, 308, 315, 60/316; 181/279, 280

[56] References Cited

U.S. PATENT DOCUMENTS

| | | | |
|---|---|---|---|
| 1,388,107 | 8/1921 | Ernst | 181/279 |
| 4,050,539 | 9/1977 | Kashiwara | 181/280 |
| 4,222,456 | 9/1980 | Kasper | 181/280 |

FOREIGN PATENT DOCUMENTS

| | | | |
|---|---|---|---|
| 539037 | 4/1932 | Fed. Rep. of Germany | 60/308 |
| 45124 | 3/1935 | France | 181/280 |
| 1132431 | 11/1956 | France | 181/280 |
| 5598 | of 1895 | United Kingdom | 181/279 |
| 21554 | of 1901 | United Kingdom | 181/279 |
| 125775 | 4/1919 | United Kingdom | 181/280 |

*Primary Examiner*—Douglas Hart

*Attorney, Agent, or Firm*—Jordan and Hamburg

[57] ABSTRACT

Means for accelerating the discharge of exhaust gas from an internal combustion engine, adapted to be mounted to the end of the engine exhaust pipe, in which exhaust gas from the engine is swirlingly guided by a plurality of spiral blades disposed in a tubular member, to form a super low pressure space at the center of the exhaust gas flow, thereby to accelerate the discharge of the exhaust gas.

7 Claims, 5 Drawing Figures

MEANS FOR ACCELERATING THE DISCHARGE OF EXHAUST GAS FROM AN INTERNAL COMBUSTION ENGINE

BACKGROUND OF THE INVENTION

The present invention relates to means for accelerating the discharge of exhaust gas from the internal combustion engine of a motor vehicle or the like.

It is known that recent severe regulation on exhaust gas from motor vehicles has accompanied such a problem as an increase in fuel consumption or a decrease in engine output. Namely, due to such exhaust gas regulation, the exhaust gas discharging capacity of the engine is decreased.

SUMMARY OF THE INVENTION

The present invention is proposed in view of the defect above-mentioned in prior art, and has an object to provide a means for accelerating the discharge of exhaust gas from an internal combustion engine, which may generate a peculiar flow of exhaust gas with the use of flowing energy inherent to exhaust gas flow from the engine, thereby to improve the exhaust gas discharging capacity of the engine, so that the saving of fuel and the enhancement in engine output may be achieved.

The means for accelerating the discharge of exhaust gas from an internal combustion engine in accordance with the present invention comprises a tubular member adapted to be communicatingly connected to the end of an engine exhaust pipe, and a plurality of spiral blades made of thin plate for spirally flowing and guiding exhaust gas and defining a space adjacent the axial center of the tubular member.

The tubular member has a first tubular portion of which diameter is gradually widened in the exhaust gas flow direction along the axial direction of the tubular member, a second tubular portion gradually tapering off in the exhaust gas flow direction, and a trumpet-shape tubular portion of which diameter is suddenly widened from the smallest diameter portion of the second tubular portion.

The spiral blades are disposed in the tubular member between the first tubular portion and the second tubular portion thereof. Each of the spiral blades has an arcuate or substantially arcuate section in the widthwise direction of the spiral blade plate at right angle to the spiral direction thereof. Each of the spiral blades has, at that part of its inner edge located at the slightly upstream side of the exhaust gas flow with respect to the largest diameter portion of the first tubular portion of the cylindrical member, a tongue piece adapted to guide exhaust gas flowing toward said part, to the exhaust gas downstream side in the radially external direction of the tubular member. Each of the spiral blades further has, at its end opposite to the smallest diameter portion of the second tubular portion of the tubular member, a steeply inclined tongue piece adapted to impart a rapid swirling force to spirally flowing exhaust gas, thereby to guide the exhaust gas into the trumpet-shape tubular portion.

The present invention has following characteristics (a) to (d).

(a) Since the upstream portion and the intermediate portion of each spiral blade are slightly arcuated in the blade plate widthwise direction and also in the blade plate longitudinal direction owing to its spiral form, so turbulence is generated in exhaust gas flowing along the axial direction of the tubular member, although the flowing direction of exhaust gas is changed at the upstream and intermediate portions. Namely, the exhaust gas is spirally flowed in a satisfactory streamline flow. Such phenomenon would be understood from the fact that, when city water from a water plug falls on the convexed back surface of a spoon for example, water flows smoothly along such convexed back surface without springing up thereon.

(b) The first tubular portion opposite to the upstream and intermediate portions of the spiral blades is gradually flared so that the exhaust gas flow therein is spread out, and the tongue pieces formed at the inner edges of the upstream portions of the spiral blades smoothly guide the exhaust gas flowing toward these tongue pieces, in the direction away from the space above-mentioned. From these two facts, a pressure generated in such space is accelerately decreased and the density of exhaust gas is decreased to lower the viscous resistance.

(c) Since a rapid swirling force is imparted to exhaust gas by the downstream portions, particularly the steeply inclined tongue pieces, of the spiral blades and thus swirled flow is then compressed by the tapering second tubular portion opposite to the downstream portions of the spiral blades, a super low pressure is generated in the space above-mentioned. If exhaust gas is merely swirled suddenly while being compressed, such compressive swirling may provoke an increase in resistance. However, according to the present invention, immediately after having been compressed and suddenly swirled, exhaust gas is suddenly spread out by the trumpet-shape cylindrical portion while being maintained in its suddenly swirled state, thereby to greatly restrain such increase in resistance.

(d) If exhaust gas is gushed to the air only in a swirled state, the air is sucked to the super low pressure space. However, according to the present invention, as mentioned at (c) above, provision is made so that, immediately after having been compressingly swirled, exhaust gas is suddenly spread out while maintained in its swirled state, thereby to provide an extremely high Venturi effect. Therefore, suction toward the super low pressure space is performed only from the engine exhaust pipe side.

As mentioned in (a) to (d) above, according to the present invention, since the occurrence of resistance is restrained as much as possible in spite of the swirling and compression of exhaust gas to generate a super low pressure in the space, the super low pressure phenomenon ultimately remains in the space, and provision is made so as to prevent the air from being sucked to this super low pressure space. Accordingly, exhaust gas from the engine is positively sucked to the super low pressure space. That is, according to the present invention, the exhaust gas discharging capacity of an engine is greatly improved and the amount of residual exhaust gas in the engine after explosive combustion is lessened, thereby to enhance the explosive combustion ability of fuel, whereby the saving of fuel and the enhancement in engine output may be achieved as desired.

Other objects and advantages of the present invention will be apparent from the following description.

BRIEF DESCRIPTION OF THE DRAWINGS

The invention will be further described, by way of example, with reference to the accompanying drawings, in which.

DETAILED DESCRIPTION OF THE PREFERRED EMBODIMENTS

Figure 1:
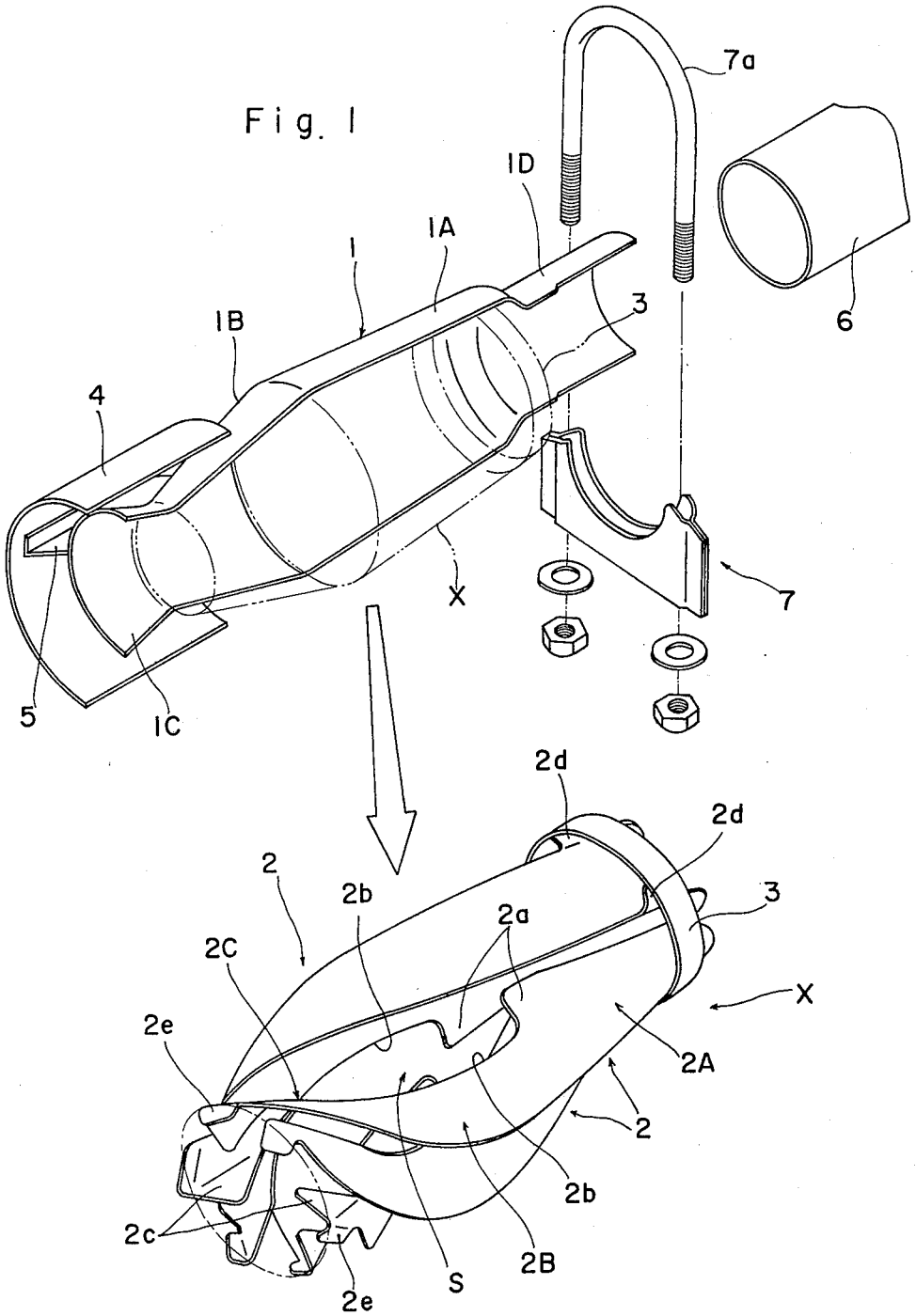
FIG. 1 is a perspective view, with portions broken away, of a mean for accelerating the discharge of exhaust gas from an internal combustion engine in accordance with the present invention, with a spiral blade unit taken out in a disassembled manner therefrom.

A tubular member 1 is communicatingly fixed and connected to the end of an engine exhaust pipe 6 through a fastening metal 7 having a U-bolt 7*a*. The tubular member 1 has a first tubular portion 1A of which diameter is gradually widened in the exhaust gas flow direction along the axial direction of the tubular member 1, a second tubular portion 1B which is connected to the largest diameter end of the first tubular portion 1A and tapers off gradually in the exhaust gas flow direction, and a trumpet-shape tubular portion 1C of which diameter is suddenly widened from the smallest diameter end of the second tubular portion 1B.

A connecting tubular portion 1D is connected to the smallest diameter end of the first tubular portion 1A.

A spiral blade unit X comprising circumferentially disposed six spiral blades 2 made of stainless steel thin plate and a ring 3, is fixedly inserted into the inner peripheral surface of the tubular member 1 between the first tubular portion 1A and the second tubular portion 1B thereof, in such a manner as to spirally flow and guide exhaust gas from the engine. For the spiral blade unit X, it is necessary to dispose a plurality of spiral blades 2, preferably five or six blades, although the number of blades is not limited to five or six.

Each of the spiral blades 2 has a slightly arcuate or substantially arcuate section in the widthwise direction of the spiral blade plate at right angle to the spiral direction thereof. Each of the spiral blades 2 integrally has, at that part of its inner edge located at the slightly upstream side of the exhaust gas flow with respect to the largest diameter portion of the first tubular portion 1A, a smooth tongue piece 2*a* turned in the arcuate shape for guiding exhaust gas flowing toward said part, to the exhaust gas downstream side in the radially external direction of the tubular member. Each of the spiral blades 2 integrally has, at its end opposite to the smallest diameter portion of the second tubular portion 1B, a steeply inclined tongue piece 2*c* for imparting a rapid swirling force to spirally flowing exhaust gas, thereby to guide the exhaust gas into the trumpet-shape tubular portion 1C, this tongue piece 2*c* being formed by turning the downstream end of each spiral blade 2.

Each of the spiral blades has an upstream portion 2A, an intermediate portion 2B and a downstream portion 2C.

Each of the upstream portions 2A has the tongue piece 2*a* at its position adjacent the downstream end of exhaust gas flow therein. Each of the intermediate portions 2B has a notch 2*b* and has a shape as substantially extending the upstream portion 2A as it is, with a swirling rate substantially same as that of the upstream portion 2A. The downstream portions 2C are steeply swirled and connected to the intermediate portions 2B. These downstream portions 2C have at the downstream end thereof the steeply inclined tongue pieces 2*c* which are spiralled more than the downstream portions 2C.

A mounting tongue piece 2*d* is turningly connected to the upstream end of each upstream portion 2A.

Each of the downstream portions 2C has, at the downstream end thereof, a mounting tongue piece 2*e* formed by turning the downstream end thereof in the opposite direction with respect to the steeply inclined tongue piece 2*c*.

The spiral blades 2 are securely spot-welded at the upstream side mounting tongue pieces 2*d*, to the ring 3. The ring 3 is securely welded to the inner periphery of the smallest diameter portion of the first tubular portion 1A, and the downstream side mounting pieces 2*e* are securely welded to the inner periphery of the smallest diameter portion of the second tubular portion 1B.

It is to be understood that, without the intermediation of the ring 3, the spiral blades 2 may be securely welded to the inner surface of the first tubular portion 1A.

Figure 2:
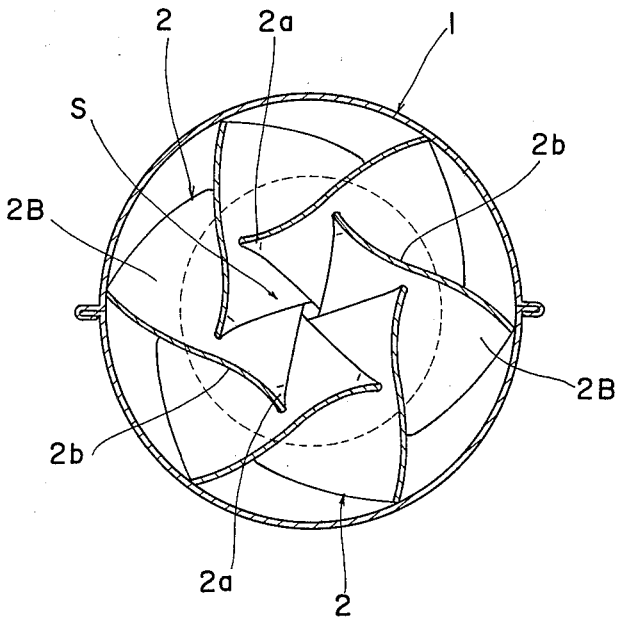
FIG. 2 is a longitudinal section view of the means shown in FIG. 1.

FIG. 2 is a section view of the spiral blade unit X at the intermediate portions 2B. As discussed earlier, these intermediate portions 2B have slightly or substantially arcuate sections, and the upstream portions 2A have arcuate sections similar to those of the intermediate portions 2B.

A super low pressure generating space S is formed by the respective inner edges of the spiral blades.

In FIG. 1, a tubular element 4 surrounds and is connected to, through a connecting member 5, the outside of the tubular member 1 in the range from the intermediate portion of the second tubular portion 1B, to a position apart in the downstream direction from the largest diameter end of the trumpet-shape tubular portion 1C, with a suitable distance provided between the tubular member 1 and the tubular element 4.

Figure 3:
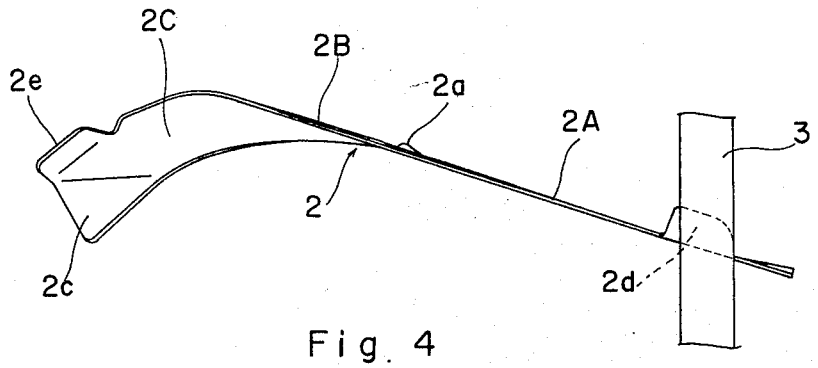
FIG. 3 is a plan view of one spiral blade in the spiral blade unit with other spiral blades not shown.
Figure 4:
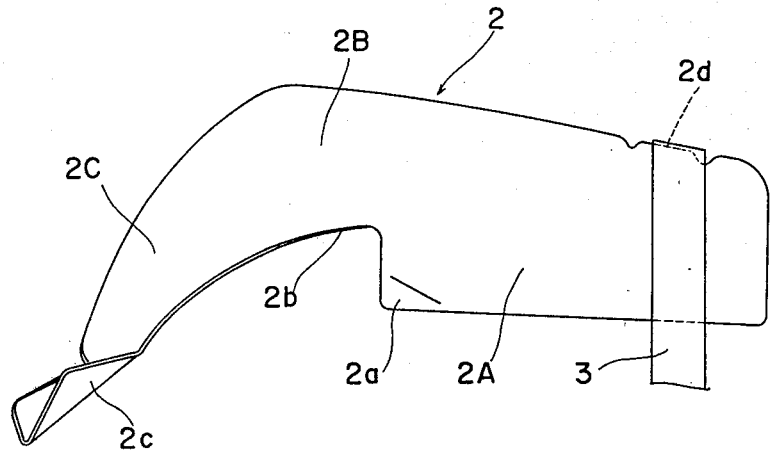
FIG. 4 is a front view of the spiral blade shown in FIG. 3.
Figure 5:
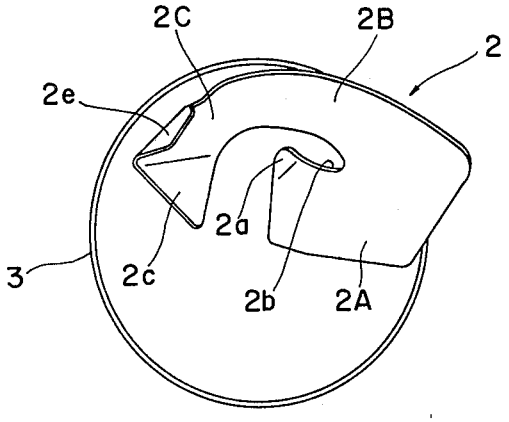
FIG. 5 is a side view of the spiral blade shown in FIG. 3.

FIGS. 3 to 5 illustrate one spiral blade 2 of the spiral blade unit X, with other spiral blades 2 omitted in the drawing.

The description hereinafter will discuss the operation of mean for accelerating the discharge of exhaust gas from an engine in accordance with the present invention.

To exhaust gas reaching the tubular member 1 after passing through the engine exhaust pipe 6, firstly a gently swirling force is imparted by the upstream portions 2A and the intermediate portions 2B of the six spiral blades 2, and then a rapid swirling force and a further rapid swirling force are imparted by the downstream portions 2C and the steeply inclined tongue pieces 2*c*, respectively. Then, the exhaust gas gushes out from the trumpet-shape cylindrical portion 1C. Such spiral flow of the exhaust gas generates a super low pressure in the space S.

When a super low pressure is generated in the space S, since the gas pressure at the side of the engine exhaust pipe 6 is higher than that at the side of the trumpet-shape cylindrical portion 1C, exhaust gas subsequently flowing through the engine exhaust pipe 6 is sucked, thereby to accelerate the discharge of the exhaust gas.

Particularly, exhaust gas produced with the piston engine or rotary engine of a motor vehicle or the like intermittently combusted, passes through the exhaust pipe 6 and advances to the exit thereof in pulsatory motion. It is well known there is formed a vacuum in the engine exhaust gas pipe 6 immediately after exhaust gas produced by one combustion has passed through the engine exhaust pipe 6. It is apparent that such vacuum tends to pull back the discharge of exhaust gas. However, according to the present invention, exhaust gas reaching the tubular member 1 is gathered, by the action of the spiral blades 2, to the inner peripheral wall surface of the first tubular portion 1A having a diameter larger than that of the exhaust pipe 6. Therefore, the exhaust gas center portion is less subjected to the pulling-back action of such subsequently formed vacuum, so that the discharge of exhaust gas is accelerated as a whole.

When a travelling vehicle such as a motor vehicle travels with the means for accelerating the discharge of exhaust gas in accordance with the present invention mounted, the tubular element 4 is adapted to introduce the outside air flow to the outer periphery of the trumpet-shape tubular portion 1C so that such outside air flow exhibits a suction effect, whereby the discharge of exhaust gas may be further accelerated.

In the following shown is a summary of the result of a test conducted by the Japan Vehicle Inspection Association on Mar. 8, 1980, regarding fuel consumed by a motor vehicle equipped with the mean for accelerating the discharge of exhaust gas from the internal combustion engine in accordance with the present invention.

Test Object

It is an object of the test to measure the amounts of fuel consumed, at constant travelling speeds, by motor vehicles equipped with and without the means for accelerating the discharge of exhaust gas from the internal combustion engine of the present invention (Trade Name: ACCELEPOWER).

Motor Vehicle Used for Test

Name: DATSUN Type: E-PJ910
Total displacement: 1.77 liters
Kind of fuel: Lead-free gasoline Test Room Conditions Dry-bulb temperature: 26.0° C.
Wet-bulb temperature: 14.0° C.
Relative humidity: 22%
Atmospheric pressure: 749.6 mmHg.

Test Result

| | | Specified travelling speed (Km/h) | Cooling water temp. (°C.) | Lubricating oil temp. (°C.) | Fuel consumption (cc) | Measuring period of time (min) | Actual travelling speed (Km/h) | Inlet pressure (-mmHg) | consumption ratio (Km/liter) |
|---|---|---|---|---|---|---|---|---|---|
| without ACCELEPOWER mounted | 1 | 60 | 78 | 104 | 225.4 | 3 | 60.0 | 355 | 13.3 |
| | 2 | 60 | 78 | 104 | 229.0 | 3 | 60.2 | 355 | 13.1 |
| | 3 | 60 | 78 | 104 | 226.2 | 3 | 60.1 | 355 | 13.2 |
| | average | — | — | — | 226.9 | — | — | — | 13.2 |
| | 1 | 100 | 80 | 110 | 711.6 | 3 | 100.0 | 125 | 7.0 |
| | 2 | 100 | 80 | 110 | 732.3 | 3 | 100.1 | 125 | 6.8 |
| | 3 | 100 | 80 | 110 | 769.4 | 3 | 100.3 | 125 | 6.4 |
| | average | — | — | — | 737.8 | — | — | — | 6.7 |
| With ACCELPOWER mounted | 1 | 60 | 80 | 105 | 208.3 | 3 | 60.1 | 355 | 14.4 |
| | 2 | 60 | 80 | 105 | 207.9 | 3 | 60.0 | 355 | 14.4 |
| | 3 | 60 | 80 | 105 | 209.3 | 3 | 60.1 | 355 | 14.3 |
| | average | — | — | — | 208.5 | — | — | — | 14.3 |
| | 1 | 100 | 81 | 108 | 552.4 | 3 | 100.0 | 130 | 9.0 |
| | 2 | 100 | 81 | 108 | 565.7 | 3 | 100.2 | 130 | 8.8 |
| | 3 | 100 | 81 | 108 | 659.5 | 3 | 100.5 | 130 | 7.5 |
| | average | — | — | — | 592.5 | — | — | — | 8.4 |

The test result above-mentioned indicates the fuel consumption decreasing effect obtained with the use of the means of the present invention is greater as the travelling speed becomes higher, and the maximum fuel saving is approximately 25%.

I claim:

1. Means for accelerating the discharge of exhaust gas from an internal combustion engine comprising:

a tubular member (1) adapted to be communicatingly connected to an engine exhaust pipe (6) and having a first tubular portion (1A) of which diameter is gradually widened in the exhaust gas flow direction along the axial direction of said tubular member (1), a second tubular portion (1B) gradually tapering in the exhaust gas flow direction and a trumpet-shape tubular portion (1C) of which diameter is suddenly widened from the smallest diameter portion of said second tubular portion (1B); and a plurality of circumferentially disposed spiral blades (2) made of thin plate for spirally flowing and guiding exhaust gas and defining a space adjacent the axial center of said tubular member (1), said spiral blade (2) disposed in said tubular member (1) between said first tubular portion (1A) and said second tubular portion (1B) thereof, each of said spiral blades (2) having an arcuate or substantially arcuate section in the widthwise direction of the spiral blade plate at right angle to the spiral direction thereof, each of said spiral blades (2) having, at that part of its inner edge located at the slightly upstream side of exhaust gas flow with respect to the largest portion of said first tubular portion (1A), a tongue piece (**2*a*) for guiding exhaust gas flowing toward said part, to the exhaust gas downstream side in the radially external direction of said tubular member (1), each of said spiral blades (2) further having, at its end adjacent to the smallest diameter portion of said second tubular portion (1B), a steeply inclined tongue piece (2*c*) for imparting a rapid swirling force to spirally flowing exhaust gas, thereby to guide the exhaust gas into said trumpet-shape tubular portion (1C**).

2. Mean as set forth in claim 1, wherein each of the spiral blades (2) is made of a single plate, the tongue piece (**2*a*) and the steeply inclined tongue piece (2*c***)

being formed by turning the respective portions of said each spiral blade plate.

3. Means as set forth in claim 1, further comprising a ring (3) having an inner periphery to which the spiral blades (2) are secured, and an outer periphery fixed to the first tubular portion (1A).

4. Means as set forth in claim 2, wherein the number of the spiral blades (2) is six.

5. Means as set forth in claim 2, wherein the number of the spiral blades (2) is five.

6. Means as set forth in claim 4 or 5, further comprising a U-shape bolt (*7a*) for mounting the tubular member (1) to the engine exhaust pipe (6).

7. Means as set forth in claim 6, further comprising a tubular element (4) surroundingly connected to, through a connecting member (5), the outside of the tubular member (1), in the range from the intermediate portion of the second tubular portion (1B) to a position apart in the downstream direction from the largest diameter end of the trumpet-shape tubular portion (1C), with a suitable distance provided between the tubular member (1) and said tubular element (4).

* * * * *